US007409989B2

(12) United States Patent
Khomynets

(10) Patent No.: US 7,409,989 B2
(45) Date of Patent: Aug. 12, 2008

(54) WELL JET DEVICE AND THE OPERATING METHOD THEREOF FOR LOGGING HORIZONTAL WELLS

(76) Inventor: Zinoviy Dmitrievich Khomynets, d.33, ul. Vilshanetskaya, Tismenitsa, obl.Ivano-Frankovskaya (UA) 77400

( * ) Notice: Subject to any disclaimer, the term of this patent is extended or adjusted under 35 U.S.C. 154(b) by 95 days.

(21) Appl. No.: 10/595,728

(22) PCT Filed: Jun. 22, 2004

(86) PCT No.: PCT/RU2004/000239

§ 371 (c)(1),
(2), (4) Date: May 7, 2006

(87) PCT Pub. No.: WO2005/050029

PCT Pub. Date: Jun. 2, 2005

(65) Prior Publication Data

US 2007/0081903 A1 Apr. 12, 2007

(30) Foreign Application Priority Data

Nov. 20, 2003 (RU) ..... 2003133504

(51) Int. Cl.
*E21B 47/01* (2006.01)

(52) U.S. Cl. ..... 166/250.01; 166/101

(58) Field of Classification Search ..... 166/105, 166/372, 101, 250.01
See application file for complete search history.

(56) References Cited

U.S. PATENT DOCUMENTS 3,892,274 A * 7/1975 Dill ..... 166/222
4,168,747 A * 9/1979 Youmans ..... 166/254.2
4,293,283 A 10/1981 Roeder
4,501,337 A * 2/1985 Dickinson et al. ..... 175/171
4,744,730 A 5/1988 Roeder

FOREIGN PATENT DOCUMENTS

RU 2059891 5/1996
RU 2121610 11/1998

* cited by examiner

*Primary Examiner*—Jennifer H Gay
*Assistant Examiner*—Brad Harcourt
(74) *Attorney, Agent, or Firm*—Patenttm.us

(57) ABSTRACT

A well jet device comprises a packer on a tubing string, a jet pump nozzle and mixing chamber and stepped through channel and sealing unit with an axial channel and mountable in said stepped channel. A flexible tube with logging device for measuring on the lower end thereof is passed through the axial channel, movable with respect thereto. Packer releasing is carried out on attaining a specified depth. The logging device is run into the well in production formation areas via said flexible tube. During downwards running, a sealing unit is mounted in the through channel and background values of physical parameters are recorded. Afterwards, fluid working medium is supplied to the jet pump nozzle, forming a series of different-value depressions in the under-packer space. Well flow rate and physical parameters are measured. The device is raised and tubing string, jet pump and released packer are extracted.

6 Claims, 2 Drawing Sheets

WELL JET DEVICE AND THE OPERATING METHOD THEREOF FOR LOGGING HORIZONTAL WELLS

FIELD OF THE INVENTION

The present invention relates to the field of pumping engineering, particularly to well jet devices for extracting oil from wells.

PRIOR ART

A well jet device is known, which comprises a jet pump arranged on a tubing string and a perforator arranged below the said jet pump (SU 1146416 A1).

The same source discloses a method of operating the said well jet device, which comprises lowering a tubing string together with a jet pump, a packer and a perforator into a well, placing the perforator in front of a production formation, and shooting the perforator with subsequently pumping an operating fluid through the jet pump.

The said device enables to carry out well perforation and, due to it, intensify pumping-out of various extractable fluids, e.g., oil, from a well.

This device, however, does not enable to carry out studying near-well areas of formations, which, in a number of cases, results in reduced work efficiency while intensifying the well operation due to lack of information on how perforated formations behave. Thus, the efficiency of the works on draining wells is insufficient for producing anticipated results.

The closest to this invention as to the technical essence and the achieved result in the part of the device is a well jet device arranged on a tubing string, which comprises a packer with an axial channel and a jet pump comprising an active nozzle, a mixing chamber and a stepped through channel having a mounting seat for installing a sealing unit with an axial channel, a transmitter and a receiver-transducer of physical fields arranged in the under-packer area on the jet pump side for entry of the medium pumped out of the well, the said receiver-transducer being installed on a logging cable passed through the said axial channel of the said sealing unit, the output side of the jet pump being connected to the space surrounding the tubing string, the jet pump channel side for entry of the pumped out medium being connected to the inner cavity of the tubing string below the sealing unit, the input side of the channel for supplying the working medium to the said active nozzle being connected to the inner cavity of the tubing string above the sealing unit (RU 2121610 C1).

The same patent discloses a method of operating a well jet device, which comprises arrangement on the tubing string of a jet pump with a through channel and a packer, lowering of the whole assembly into a well, release of the packer and creation of a necessary depression in the under-packer area by pumping a liquid medium out of the under-packer area with the use of the said jet pump.

The known well jet device and the operating method thereof enable to carry out various process operations in a well below the level at which the jet pump is arranged, including those consisting in reducing a pressure differential above and below the sealing unit.

But, the cited device does not enable to utilize its capabilities in full, since it enables to study producing rocks only in boreholes close to vertical, which narrows the field of using that operating method and that well jet device for realizing it. Furthermore, the jet pump dimensions are not optimized for works on studying open borehole wells when using a jet pump together with autonomous logging blocks.

SUMMARY OF THE INVENTION

The task to be solved by this invention is to intensify works on studying, testing and completing wells, primarily horizontal wells having a great curvature; to optimize the jet pump arrangement and dimensions when using it together with a logging device; and, owing to this, to improve the reliability of the well jet device operation.

The stated task in the part of the device is solved owing to the fact that the well jet device comprises, all of them being arranged on a tubing string, a packer, a jet pump, in the body of which an active nozzle and a mixing chamber with a diffuser are arranged as well as a stepped through channel is made, and a sealing unit with an axial channel is arranged in the stepped through channel, a flexible tube with a logging device for measuring physical quantities, e.g., a specific resistance of rocks, being arranged on the lower end thereof, and the jet pump being arranged over the producing formations in a well at a distance h, being equal to:

$$h \geq \frac{P_f - \Delta P}{g\sigma},$$

and being made with the following dimensional relations: the relation of the diameter $D_{cc}$ of the mixing chamber cross-section to the diameter $D_c$ of the nozzle output cross-section is from 1.1 to 2.4; the relation of the mixing chamber length $L_c$ to the diameter $D_{cc}$ of the mixing chamber cross-section is from 3 to 7; the relation of the nozzle length $L_n$ to the diameter $D_c$ of its output cross-section is from 1 to 8; the distance L from the nozzle output cross-section to the mixing chamber input cross-section is from 0.3 to 2 diameters $D_c$ of the nozzle output cross-section; and the angle $\alpha$ between the diffuser generatrix and the diffuser longitudinal axis is from 4° to 14°, where:

h is the vertical component of the distance between the jet pump and the bottom of the production formations, in meters;

$P_f$ is the formation pressure, in $N/m^2$;

$\Delta P$ is the maximum allowable value of depression on a production formation, in $N/m^2$;

g is the acceleration of gravity, in $m/s^2$;

$\sigma$ is the fluid density in a well, in $kg/m^3$.

The stated task in the part of the device is also solved owing to the fact that the wall of the said flexible tube from its lower end may be made with holes, and the outer diameter $D_{fl}$ of the flexible tube may relate to the outer diameter $D_s$ of the sealing unit as $D_{fl} \leqq (0.3\text{-}0.7)\ D_s$.

The stated task in the part of the method is solved owing to the fact that the method of operating of the well jet device consists in that a jet pump with a through channel made in its body and a packer with a through channel, as arranged below the jet pump, are lowered into a well on a tubing string; at the given depth the packer is released, the latter being arranged over the production formations under study; then a logging device, as arranged on the lower end of the flexible tube, is lowered on the flexible tube with the perforated lower section along the tubing string and arranged in the area of the production formations, and in the lowering process a sealing unit being arranged in the through channel of the jet pump, and background values of the physical parameters of the production formations in the near-borehole area are registered with the use of the logging device in the well; after that an operating fluid is fed into the nozzle of the jet pump, thus creating a series of different value depressions in the under-packer space, measuring the well flow rate at each depression value;

then the physical parameters of the formation fluid, which is coming into the well, and those of production formations are measured by moving the logging device on the flexible tube along the formations; and, after completing measurements, the logging device is raised on the surface, the packer is released, and the tubing string together with the jet pump and the packer is extracted.

The stated task in the part of the method may be also solved owing to the fact that an additional study of production formations may be carried out, for which purpose a liquid having anomalous physical properties, e.g., abnormally high section of thermal capture, is pumped into the well over the flexible tube through its lower perforated section, or the near-borehole area in the production formations is chemically treated by pressuring chemical agents into the production formations after which the production formations are studied; studies with the use of the logging device may be carried out when the jet pump is in operation or is stopped.

An analysis of the well jet device operation shows that the operational reliability may be improved both by optimizing the sequence of actions carried out during testing and completing wells, first of all with open or curvilinear boreholes and by optimizing the arrangement of the jet pump in a well and making the jet pump under precisely defined dimensions.

It has been found that the above sequence of actions enables most efficiently use the equipment, which is arranged on the tubing string, during works on studying and testing production formations in rocks by forming conditions for obtaining full and reliable information on the condition of the production formations. By creating a series of different-value depressions the jet pump forms in a well the given values of pressure differential, and the well is studied and tested with the use of the logging device. Simultaneously, it is possible to control depression values by controlling the pumping rate of the operating fluid. By carrying out formation testing it is possible to adjust the pumping-out mode by changing the pressure of the operating fluid fed into the nozzle of the jet pump. The arrangement of the logging device on a flexible tube, which is passed through the sealing unit with the possibility of axial movement, enables to carry out better work on testing a well and preparing it for operation as well as enables to treat a well and prepare it for operation without rearranging the well jet device, which makes the process of testing and completing a well quicker and simpler. Thus, the claimed device and the method of operating it enable to conduct quality studies and tests of wells after their drilling as well as to prepare wells for operation after comprehensively studying and testing them in different operation modes.

It has been established during the conducted study that for the purpose of obtaining reliable information it is necessary to arrange the jet pump over the formations at a certain height. At that a necessity arises to make the jet pump under precisely defined dimensions in order to coordinate the jet pump operation with the logging device operation. Only in such case it becomes possible to achieve obtaining comprehensive and real information on the condition of the formation production rocks.

Thus, the above totality of the interdependent parameters and the sequence of actions ensures the fulfillment of the task stated for the invention, namely, to intensify works on studying and testing wells having curvilinear boreholes, including open ones, as well as to optimize the arrangement and the dimensions of the jet pump when using it together with a logging device, thus improving the reliability of the well jet device operation.

DESCRIPTION OF THE PREFERRED EMBODIMENT

Figure 1:
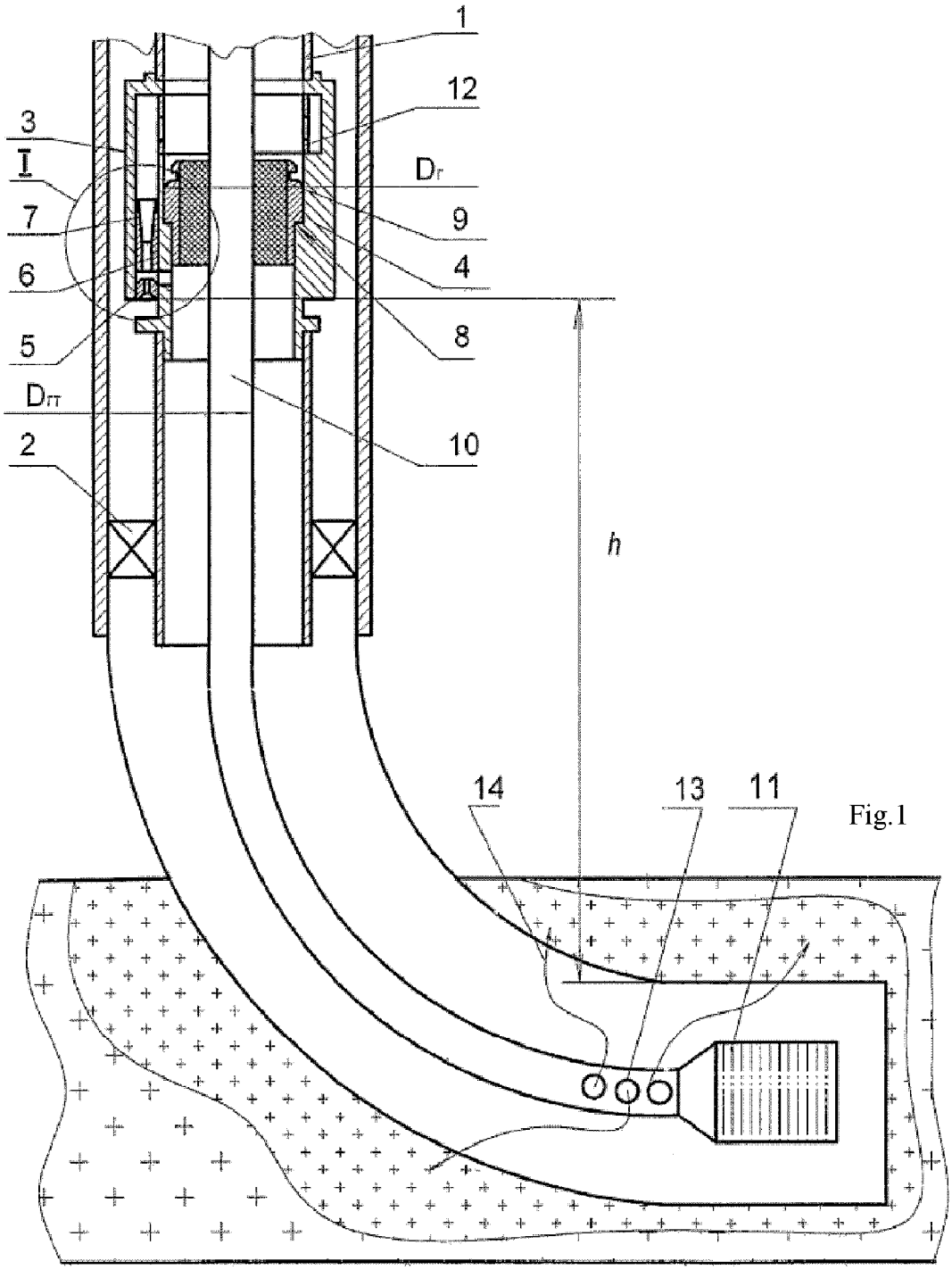
FIG. 1 shows a lengthwise section of the claimed device.
Figure 2:
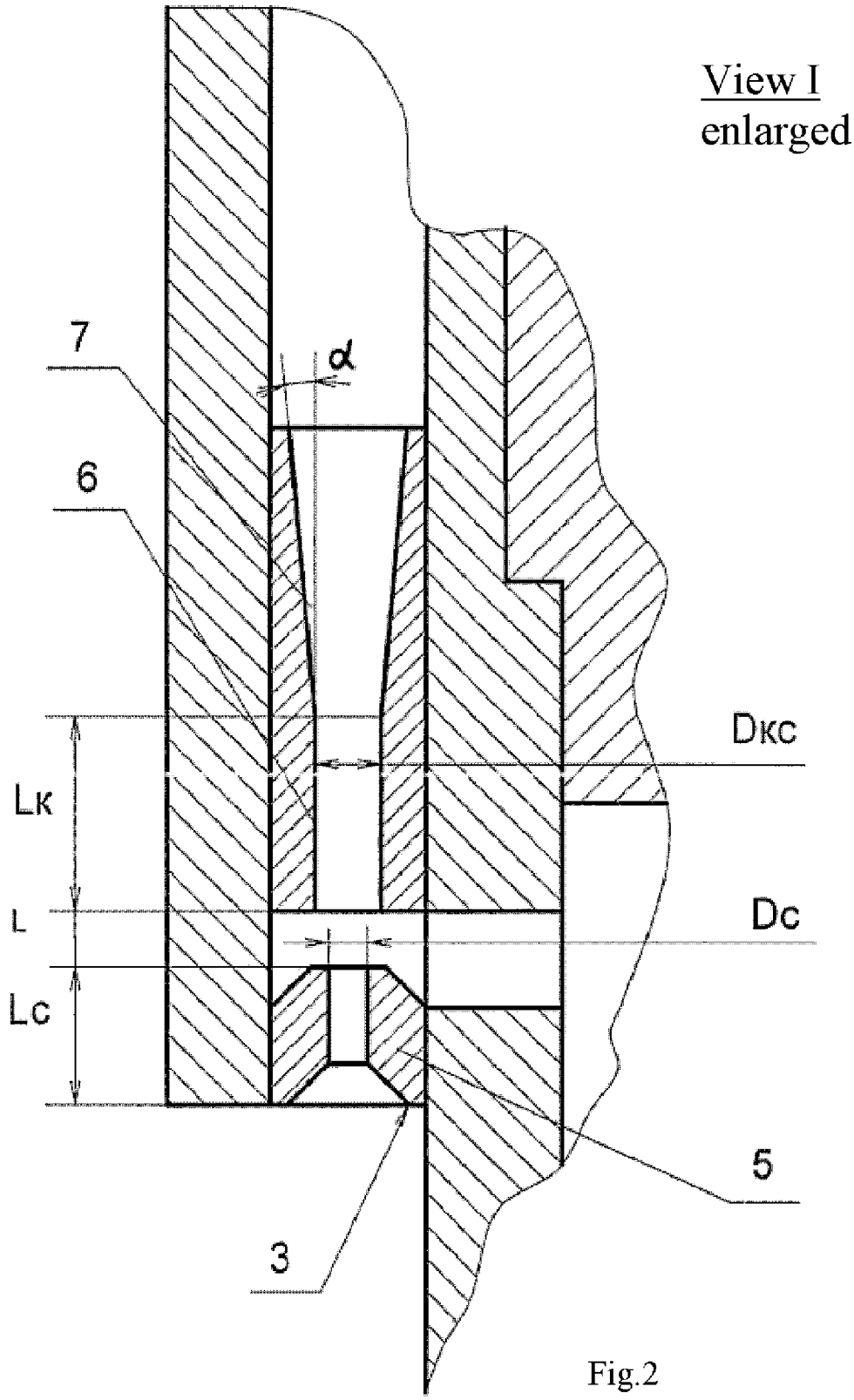
FIG. 2 shows an expanded cut-away I from FIG. 1.

The claimed well jet device for carrying out the claimed method comprises, all of them being arranged on the tubing string 1, the packer 2, the jet pump 3, in the body 4 of which the active nozzle 5 and the mixing chamber 6 with the diffuser 7 are arranged as well as the stepped through channel 8 is made. The sealing unit 9 is arranged in the stepped through channel 8. Below the packer 2, on the flexible tube 10 the logging device 11 for measuring physical quantities, e.g., a specific resistance of rocks, is arranged. The jet pump 3 is arranged over the producing formations in a well at a distance h, being equal to:

$$h \geq \frac{P_f - \Delta P}{g\sigma},$$

where:

h is the vertical component of the distance between the jet pump and the bottom of the production formations, in meters;

$P_f$ is the formation pressure, in $N/m^2$;

$\Delta P$ is the maximum allowable value of depression on a production formation, in $N/m^2$;

g is the acceleration of gravity, in $m/s^2$;

$\sigma$ is the fluid density in a well, in $kg/m^3$.

Furthermore, the jet pump 3 is made with the following dimensional relations: the relation of the cross-section diameter $D_{cc}$ of the mixing chamber 6 to the output cross-section diameter $D_c$ of the nozzle 5 is from 1.1 to 2.4; the relation of the length $L_c$ of the mixing chamber 6 to the cross-section diameter $D_{cc}$ of the mixing chamber 6 is from 3 to 7; the relation of the length $L_n$ of the nozzle 5 to the diameter $D_c$ of its output cross-section is from 1 to 8; the distance L from the output cross-section of the nozzle 5 to the input cross-section of the mixing chamber 6 is from 0.3 to 2 diameters $D_c$ of the output cross-section of the nozzle 5; and the angle $\alpha$ between the generatrix of the diffuser 7 and the longitudinal axis of the diffuser 7 is from 4° to 14°. A protective guiding bushing 12 may be installed on the output side of the jet pump 3, which is intended for preventing damage of the logging device 11 and the jet pump 3 during lowering the logging device 11, which may be caused by the latter's striking the channel walls at the output of the jet pump 3.

The flexible tube 10 at its lower end may be made with holes 13 in its wall, and the outer diameter $D_{ft}$ of the flexible tube 10 may relate to the outer diameter $D_s$ of the sealing unit as $D_{ft} \leqq (0.3\text{-}0.7)\ D_s$.

The claimed method of operating the well jet device is carried out as follows.

The jet pump 3 with the through channel 8 made in its body 4 and the packer 2 with a through channel, as arranged below the jet pump 3, are lowered into a well on the tubing string 1. When the given depth is reached, the packer 2 is released, and the latter being arranged over the production formations under study. Then the logging device 11, as arranged on the lower end of the flexible tube 10, is lowered on the flexible tube 10 with the perforated lower section along the tubing string 1 and arranged in the area of the production formations. In the lowering process the sealing unit 9 is arranged in the through channel 8 of the jet pump 3, and background values of the physical parameters of the near-borehole area in the production formations are registered with the use of the logging device 11. At that the flexible tube 10 enables to position the logging device 11 in the area of the production formations irrespectively of the fact whether they are in a rectilinear well or in a curvilinear well. After that an operating fluid is fed into the nozzle 5 of the jet pump 3, thus creating a series of different value depressions in the under-packer space. At each depression value the well flow rate is measured, afterwards the geophysical parameters of the production formations are measured by moving along them the logging device 11 on the flexible tube 10. After completing measurements, the flexible tube 10 together with the logging device 11 and the sealing unit 9.

In a case of necessity an additional study of production formations may be carried out, for which purpose a liquid 14 having anomalous physical properties, e.g., abnormally high section of thermal capture, is pumped into the well over the flexible tube 10 through holes 13 made in its lower perforated section, or the near-borehole area in the production formations is chemically treated by pressuring chemical agents into the production formations after which the production formations are studied. Studies with the use of the logging device may be carried out when the jet pump is in operation or is stopped.

INDUSTRIAL APPLICABILITY

The present invention may be used in the oil industry for testing and completing wells as well as in other industries where various fluids are extracted from wells.

What is claimed is:

1. A well jet device comprising:

a packer;

a jet pump, in the body of which an active nozzle and a mixing chamber with a diffuser are arranged as well as a stepped through channel is made;

said packer and jet pump being arranged on a tubing string; and a sealing unit with an axial channel is arranged in the stepped through channel;

a flexible tube with a logging device for measuring physical quantities, e.g., a specific resistance of rocks, being arranged on the lower end thereof; and the jet pump being arranged over producing formations in a well at a distance h, being equal to:

$$h \geq \frac{P_f - \Delta P}{g\sigma},$$

and being made with the following dimensional relations:

the relation of the diameter $D_{cc}$ of the mixing chamber cross-section to the diameter $D_c$ of the nozzle output cross-section is from 1.1 to 2.4;

the relation of the mixing chamber length $L_c$ to the diameter $D_{cc}$ of the mixing chamber cross-section is from 3 to 7;

the relation of the nozzle length $L_n$ to the diameter $D_c$ of its output cross-section is from 1 to 8;

the distance L from the nozzle output cross-section to the mixing chamber input cross-section is from 0.3 to 2 diameters $D_c$ of the nozzle output cross-section; and the angle $\alpha$ between the diffuser generatrix and the diffuser longitudinal axis is from 4° to 14°, where:

h is the vertical component of the distance between the jet pump and the bottom of the production formations, in meters;

$P_f$ is the formation pressure, in $N/m^2$;

$\Delta P$ is the maximum allowable value of depression on a production formation, in $N/m^2$;

g is the acceleration of gravity, in $m/s^2$;

$\sigma$ is the fluid density in a well, in $kg/m^3$.

2. The well jet device according to claim 1, characterized in that the flexible tube at its lower end has holes in its wall.

3. The well jet device according to claim 1, characterized in that the outer diameter $D_{ft}$ of the flexible tube relates to the outer diameter $D_s$ of the sealing unit as $D_{ft} \leqq (0.3\text{-}0.7)\ D_s$.

4. A method of operating of the well jet device comprising:

lowering into a well on a tubing string a jet pump with a through channel made in its body and a packer with a through channel, as arranged below the jet pump, at a given depth, releasing the packer, the latter being arranged over the production formations under study;

then lowering a logging device, as arranged on the lower end of a flexible tube, on the flexible tube with a perforated lower section along the tubing string in the area of the production formations, and in the lowering process, arranging a sealing unit in the through channel of the jet pump, and registering background values of the physical parameters of production formations in the borehole area with the use of the logging device;

after that, feeding an operating fluid into the nozzle of the jet pump, thus creating a series of different value depressions in the under-packer space;

measuring the well flow rate at each depression value, then measuring the physical parameters of the formation fluid, which is coming into the well, and those of production formations by moving the logging device on the flexible tube along the formations;

after completing measurements, raising the logging device on the surface, releasing the packer; and extracting the tubing string together with the jet pump and the packer.

5. The method of operation according to claim 4, further comprising carrying out an additional study of production formations by pumping a liquid having an abnormally high section of thermal capture, into a well over the flexible tube through its lower perforated section, or chemically treating the near-borehole area in the production formations by pressuring chemical agents into the production formations and thereafter studying the production formations.

6. The method of operation according to claim 4, characterized in carrying out studies with the use of the logging device when the jet pump is in operation or is stopped.

* * * * *